United States Patent [19]

Hamilton et al.

[11] Patent Number: 4,538,142

[45] Date of Patent: Aug. 27, 1985

[54] SIGNAL SEAT FOR CHILDREN

[76] Inventors: Scott B. Hamilton, 3733 S. County Rd. #5, Fort Collins, Colo. 80525; Douglas B. Golden, 7843 SW. Ruby Ter., Portland, Oreg. 97219

[21] Appl. No.: 430,204

[22] Filed: Sep. 30, 1982

[51] Int. Cl.[3] ..... G08B 21/00

[52] U.S. Cl. ..... 340/667; 200/42 R; 297/211; 340/666; 434/322

[58] Field of Search ..... 340/667, 666, 573; 297/175, 176, 177, 178, 208, 211, 209; 272/16, 17; 434/352; 267/131, 133; 200/42 R

[56] References Cited

U.S. PATENT DOCUMENTS

| | | | |
|---|---|---|---|
| 2,249,645 | 7/1941 | Applegarth | 340/573 X |
| 2,251,141 | 7/1941 | Lehman, Jr. | 155/188 |
| 2,628,665 | 2/1953 | Orlando | 155/126 |
| 2,667,802 | 2/1954 | Harris | 84/95 |
| 2,780,693 | 2/1957 | McClellan | 340/573 X |
| 3,118,236 | 1/1964 | Van Hemel | 434/352 |
| 3,663,774 | 5/1972 | Feder | 200/42 R |
| 3,787,804 | 1/1974 | MacDonald | 340/667 X |
| 4,242,672 | 12/1980 | Gault | 340/667 X |

FOREIGN PATENT DOCUMENTS

| | | | |
|---|---|---|---|
| 0158727 | 2/1921 | United Kingdom | 340/667 |

*Primary Examiner*—James L. Rowland
*Assistant Examiner*—Thomas J. Mullen, Jr.
*Attorney, Agent, or Firm*—Henderson & Sturm

[57] ABSTRACT

This invention relates to disciplinary devices to teach young children proper behavior in general, and more specifically to a unique, tamper-proof weight activated signaling mechanism incorporated into a stool, which a child must sit on for disciplinary reasons, whereby the removal of the child's weight from the seat portion of the device, causes the signaling mechanism to be activated.

7 Claims, 2 Drawing Figures

SIGNAL SEAT FOR CHILDREN

BACKGROUND OF THE INVENTION

While the prior art is replete with musical chairs for children, as can be seen by reference to U.S. Pat. Nos.: 2,667,802; 2,251,141 and 2,628,665, these devices are intended and designed solely for the childs amusement, or to reward good behavior. In addition, all of the these reward devices normally require the application of the childs weight on the seat portion, in order to activate the musical means. In instances where a child is to be punished for bad behavior; however, these weight activated devices are not only unacceptable, but are counterproductive to the purpose intended.

A well known and widely used disciplinary technique is called "time-out" which consists of placing a child on a chair in the corner for a limited amount of time (e.g., 3–5 minutes) following noncompliance or other disruptive behavior. Oftentimes, however, the child will leave or repeatly get off the chair prior to the end of the 3-minute interval, thus requiring continual parental monitoring of the child while in "time-out". In addition, to the task interference created by continual parental monitoring, overt parental attention may inadvertently serve to reward the child's negative behavior. Moreover, should the parent decide not to monitor the child or experience an interruption in monitoring (e.g., answering the telephone), the child could easily remove him/herself from "time-out", thus defeating the original purpose of the disciplinary technique.

The purpose of this invention is to provide a means by which the parent can place the noncompliant/disruptive child in "time-out", and re-initiate household tasks in another room (e.g., cooking in the kitchen), while being assured that the child is still sitting on the "time-out" chair.

To date no one has devised a device, which is responsive to the removal of a childs weight from a seat or stool, to activate a signaling device, that warns the parent or teacher that the child is being disobedient, and makes them immediately aware that the off-the-seat rule has been violated, so that corrective measures such as spanking, extra time on the seat, or loss of privileges can be imposed.

SUMMARY OF THE INVENTION

An object of the present invention is to provide a seating device which can be used in the disciplinary technique know as "time-out".

Another object of the present invention is the provision of signaling device that will notify a parent or teacher at a remote location that a child has left the seating device, so that it is not necessary for the child to be under direct supervision and observation during the "time-out" period.

Still another object to the present invention is the incorporation of a signaling mechanism into the seat portion of a stool, wherein the signaling mechanism is actuated in response to the child getting up from the stool.

Yet another object of the present invention is the provision of an actuating mechanism used in conjunction with the signaling mechanism that can be rendered inoperative during those periods when the stool is being used for the other than disclipinary purposes.

A still another object to the present invention is the incorporation into the signal seat, of a tamper proof switch mechanism, that will prevent the child from manually disengaging the signaling mechanism from the seat, in order to frustrate the intent and purpose of the structure.

A yet further object of the present invention is the provision of a signal seat that can be used for disciplinary measures, while having a parent or teacher free to pursue other tasks, with the knowledge that if the child leaves the seat an audible signal will result.

These and other objects, advantages and novel features of the invention will become apparent from the detailed disclosure which follows, when considered in conjunction with the accompanying drawings.

DETAIL DESCRIPTION OF THE PREFERRED EMBODIMENT

Figure 2:
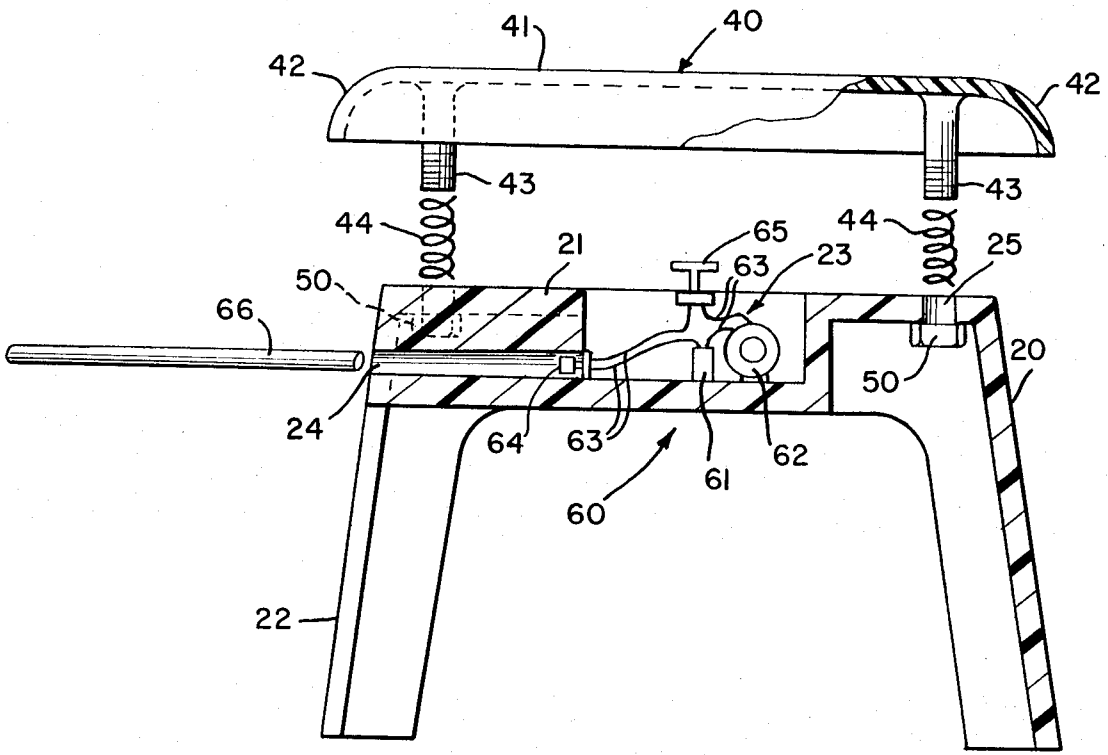
FIG. 2, is a detailed view of the actuating and signaling mechanisms employed in the signal seat, and further illustrates the cooperation between the seat and the stool.
Figure 1:
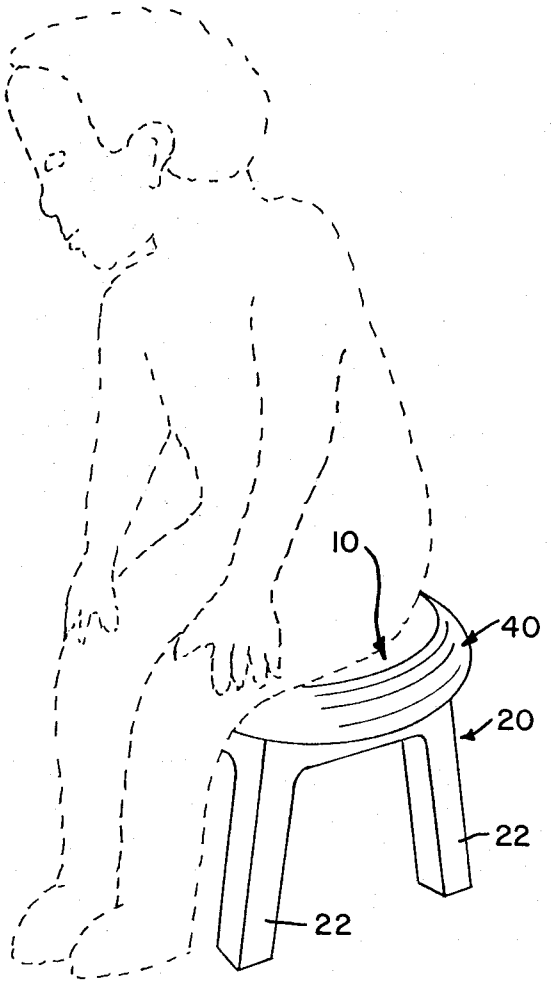
FIG. 1, is a perspective view of the signal seat used in conjunction with the disciplinary technique known as "time-out".

As can be seen by reference to FIGS. 1 and 2, the signal seat which forms the basis of the present invention is designated generally as 10, and comprises a stool member 20, and a seat member 40, which are operatively connected to one another.

The stool member 20, comprises stool legs 22, diposed on its corners. In the preferred embodiment, the stool member 20, is fabricated from molded plastic and is further provided with a central recess 23, and an elongated horizontal aperture 24, in open communication with the recess 23. In addition, the stool member 20, is further provided with a plurality of vertical apertures 25, which extend completely through the stool body 21.

The seat member 40, is also fabricated from molded plastic, and comprises a contoured seat body 41, having downwardly depending curved sides 42, and a plurality of downwardly depending threaded projections 43, which are dimensioned to be received within the vertical apertures 25, in the stool member 20.

The seat member 40, is connected to the stool member 20, by a plurality of plastic nuts 50, which are secured to the threaded projections 43, on the seat member, once they have been inserted through the vertical apertures 25, in the stool member. The threaded projections 43, are further provided with coil springs 44, around their periphery; so that the seat member will be normally biased away from the stool member in their assembled relationship.

The signal mechanism is designated generally as 60, and is disposed in the central recess 23, in the stool 20. The signal mechanism 60, further comprises a battery 61, and a signal device 62, operatively connected by suitable electrical leads 63, to two switch mechanisms 64 and 65. In the preferred embodiment illustrated, the signal device 62, is an electrically actuated buzzer mechanisms; however, any type of suitable audio and/or visual signaling system or mechanical counter and/or timer would be equally acceptable.

The first of the two switch elements 64, comprises a push-on, push-off type switch, which is disposed in the horizontal aperture 24, at the point where the aperture 24, intersects the central recess 23. The actuator for this hidden switch 64, comprises an elongated dowel 66, which is dimensioned to fit within the elongated horizontal aperture 24, and has a length sufficient to engage the plunger of the switch 64, and still project a substantial distance beyond the side of the stool 20.

The second of the two switch elements 65, is a normally closed spring loaded switch, whose plunger projects above the top of the stool body 21. The underside of the seat member forms the actuator for switch 65, and acts to open the switch when a weight sufficient to overcome the spring biasing of the seat member is applied to the upper surface of the seat 40.

Having thereby described the structural elements of the signal seat, its purpose and operation will now be explained in detail. When a childs behavior dictates that a period of "time-out" is warranted, he-she is instructed to sit on the signal seat for a designated period of time. The weight of the child causes the seat member to overcome the bias of the coil springs 44, and engage the stool member and the plunger on switch 65, to open the electrical circuit between the battery 61, and the signal device 62. The dowel 66, is then inserted into the horizontal aperture 24, and switch 64, is engaged to close that part of the electrical circuit between then battery and the signal device. The parent or teacher then removes the dowel and places it in a handy location out of the reach of the child. As soon as the child gets up from the seat, coil springs 44, will force the seat member out of engagement with the stool member and the switch 65. When this happens, switch 65, will close and complete the electrical circuit between the battery and the signal device. When the signal device is actuated the parent or teacher will be immediately aware that the "time-out" rule has been broken, and further disciplinary measures can be imposed.

With the removal of the dowel 66, it is impossible for the child to obtain access to switch 64, and since switch 65, is covered by the seat member 40, the signal seat is both tamper proof, fool-proof and child-proof.

It should be noted that switch 64, can be selectively disengaged by the dowel 66, to render the signaling device inoperative, when it is desired to use the signal seat as a normal stool.

It should also be noted that it is a very simple matter to disengage the seat member 40, from the stool member 20, by removal of the nuts 50, from the threaded ends of the projections 43, on the seat member, for repair or replacement of the signal mechanism components.

Having thereby described the subject matter of this invention, it should be obvious that many substitutions, modifications and variations of the invention are possible in light of the above teachings. It is therefore to be understood, that the invention as taught and described is only to be limited to the extent of the breadth and scope of the appended claims.

1. A signal seat for use in the disciplinary technique known as "time-out"; wherein the signal seat comprises, a stool member provided with: a normally closed first switch projecting above its surface; a recess adapted to receive a battery and a signal device; and an elongated aperture that is in open communication with the recess and the exterior of the stool member;

a seat member moveably mounted to said stool member, and having a surface adapted to engage said first switch to open the switch;

a battery and signal device operatively connected by electrical leads to said first switch device, whereby the signal device will be activated when the electrical circuit is completed;

a second switch operatively connected to the electrical circuit between the battery and the signal device to selectively open and close the electrical circuit; and an elongated removable dowel dimensioned to be received within said elongated aperture, and having a length sufficient to engage said second switch while still projecting a substantial distance beyond said stool member.

2. A signal seat as in claim 1: wherein, the seat member is normally spring biased away from engagement with the upper surface of the stool member.

3. A signal device as in claim 1; wherein, the second switch is disposed in the elongated aperture.

4. A signal seat as in claim 3; wherein, the stool member is provided with a plurality of vertical apertures extending thru the stool member; and the seat member is provided with a plurality of threaded downwardly depending projections, which are dimensioned to be received within the vertical apertures in the stool member.

5. A signal seat as in claim 4; wherein, coil springs surround said projections, and bias the seat member away from engagement with the stool member.

6. A signal seat as in claim 5; wherein, a plurality of nuts engage the threaded projection to secure the seat member to the stool member.

7. A signal device as in claim 1; wherein, the second switch is disposed in the said recess in the stool member.

* * * * *